US005211525A

United States Patent [19]

Moltrasio

[11] Patent Number: 5,211,525

[45] Date of Patent: May 18, 1993

[54] DEVICE FOR UNBINDING SACKS BOUND INTO PACKS

[76] Inventor: Mario Moltrasio, Via Ruvigliana, 12, Viganello, Switzerland

[21] Appl. No.: 705,394

[22] Filed: May 24, 1991

[30] Foreign Application Priority Data

Jun. 8, 1990 [IT] Italy ..... 2931 A/90

[51] Int. Cl.[5] ..... B65B 69/00

[52] U.S. Cl. ..... 414/412; 83/176; 83/909

[58] Field of Search ..... 414/412; 198/644; 83/156, 176, 435.2, 909

[56] References Cited

U.S. PATENT DOCUMENTS

| | | | |
|---|---|---|---|
| 3,513,522 | 5/1970 | Thomson | 83/909 X |
| 4,119,227 | 10/1978 | Hafner et al. | 414/412 |
| 4,158,417 | 6/1979 | Inoue | 414/412 |
| 4,344,268 | 8/1982 | Wakamatsu et al. | 414/412 X |
| 4,390,313 | 6/1983 | Hoehn | 414/412 |
| 4,586,232 | 5/1986 | Ohmura et al. | 29/146.3 |
| 4,976,583 | 12/1990 | Moltrasio | 83/909 X |
| 4,997,329 | 3/1991 | Hanamoto et al. | 414/412 |
| 5,074,739 | 12/1991 | Takahashi et al. | 414/412 |

FOREIGN PATENT DOCUMENTS

| | | | |
|---|---|---|---|
| 839871 | 6/1981 | U.S.S.R. | 414/412 |
| 1244033 | 7/1986 | U.S.S.R. | 414/412 |
| 1555197 | 4/1990 | U.S.S.R. | 83/909 |
| 2076355 | 12/1981 | United Kingdom . | |

*Primary Examiner*—David A. Bucci
*Attorney, Agent, or Firm*—Steinberg & Raskin

[57] ABSTRACT

Packs formed from a group of sacks bound by straps for feeding to so-called sack applicators are conveyed continuously in succession by a particular arrangement of endless driven belts, comprising a belt acting on the lower central part of the pack and a central upper belt and two lateral belts or shoes acting on the upper side parts of the pack to result in transverse arching of the pack and the insertion of a fixed reference member between the pack and strap to bring the strap into contact with a rotary cutter for its cutting. The hanging cut part of the strap is led between cooperating inclined rollers which remove the strap.

11 Claims, 4 Drawing Sheets

DEVICE FOR UNBINDING SACKS BOUND INTO PACKS

BACKGROUND OF THE INVENTION

This invention relates to a device for unbinding sacks contained in a pack and bound together by straps or the like.

With particular but not exclusive reference to the cement industry it is well known that the handling of empty sacks requires labour, to the detriment of productivity and of the cost of sacking the cement. A method for reducing the labour required for sack handling and an arrangement for its implementation have already been proposed in Italian patent application No. 19266A/89 of Jan. 31, 1989 in the name of Mario Moltrasio. In this method, the binding (strap) is spaced from a region of the pack and the binding is cut in this spaced region. This method is implemented by a device in which the pack is supported laterally by a pair of parallel bands or belts, and a stationary profiled member is inserted between the pack and binding to space them apart in order to enable this latter to be cut by a rotary blade. In this preceding embodiment the spacing is achieved by a stationary member which is inserted at its front between the binding and pack in the manner of a blade. This does not allow high productivity to be achieved as there is the danger that the front blade-like part of the stationary member may damage the lowest sack of the pack.

SUMMARY OF THE INVENTION

The object of the present invention is to provide a device which gives optimum reliability of operation and high productivity, without damaging the sacks.

A further object of the present invention is to provide a device for unbinding the packs of sacks which is reliable, is adjustable to adapt to the number of sacks contained in the pack, is of simple construction and hence easy maintenance, is of relatively small overall size and, except for its initial adjustment, does not require manual intervention, being essentially of automatic operation.

These and further objects which will be apparent from the detailed description given hereinafter are attained by a device for unbinding packs of sacks, characterised essentially by comprising, in cooperation with a profiled stationary surface on which the pack moves and rests, at least one endless conveyor belt or band positioned centrally to said surface and arranged to operate on the pack, there being also provided two lateral conveyors or profiled slide guides arranged to operate on the upper side of the pack in such a manner as to exert an action which counteracts that exerted centrally by the initially stated conveyor, to create a transverse deformation of the pack in order to allow insertion of a stationary guide between the pack and binding, and cutting by a rotary blade associated with said stationary guide.

Further important aspects of the invention will be apparent from the detailed description of a preferred embodiment thereof given hereinafter by way of non-limiting example and illustrated on the accompanying drawing.

DETAILED DESCRIPTION OF THE INVENTION

Figure 1:
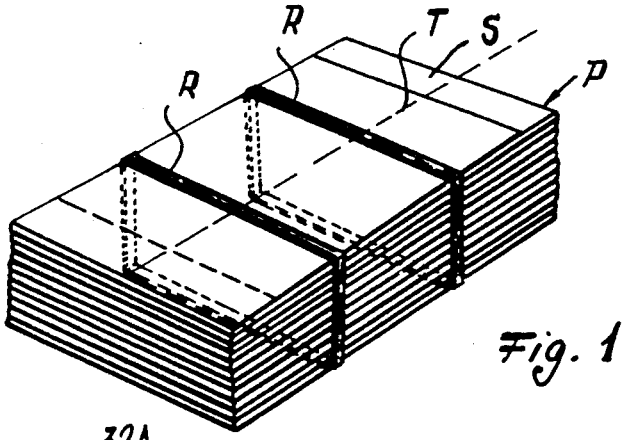
FIG. 1 is a schematic perspective view of a pack of sacks bound by two straps.
Figure 3:
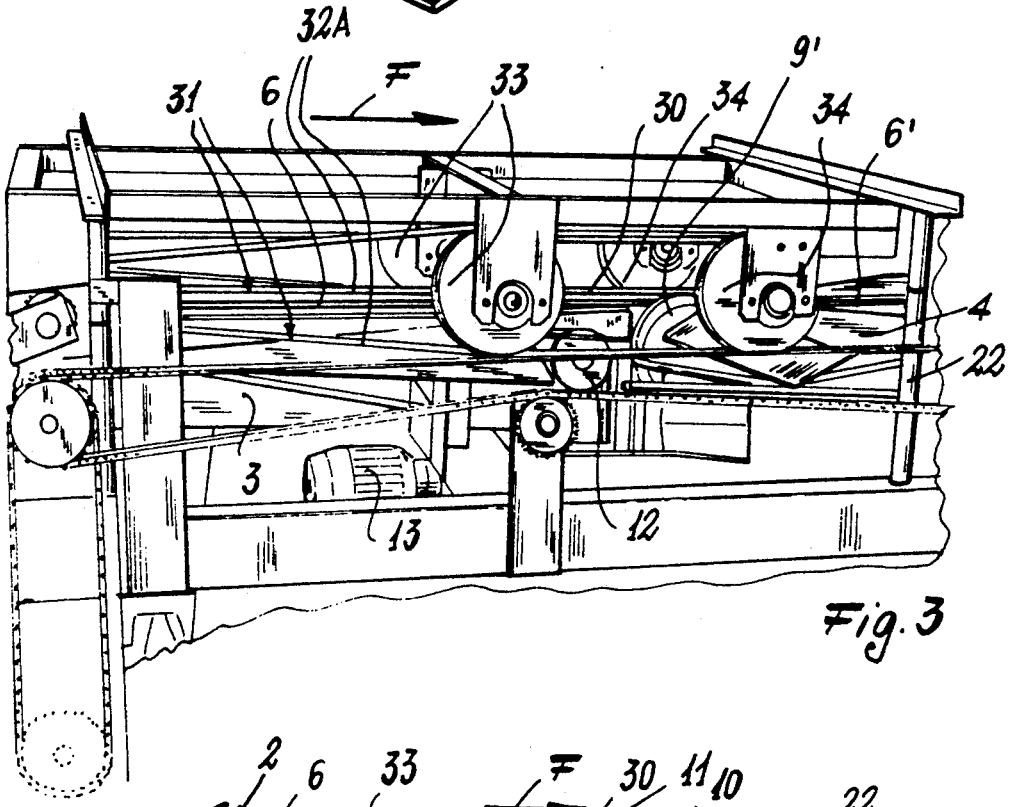
FIGS. 3 to 6 are perspective views of details of the device according to the invention.
Figure 4:
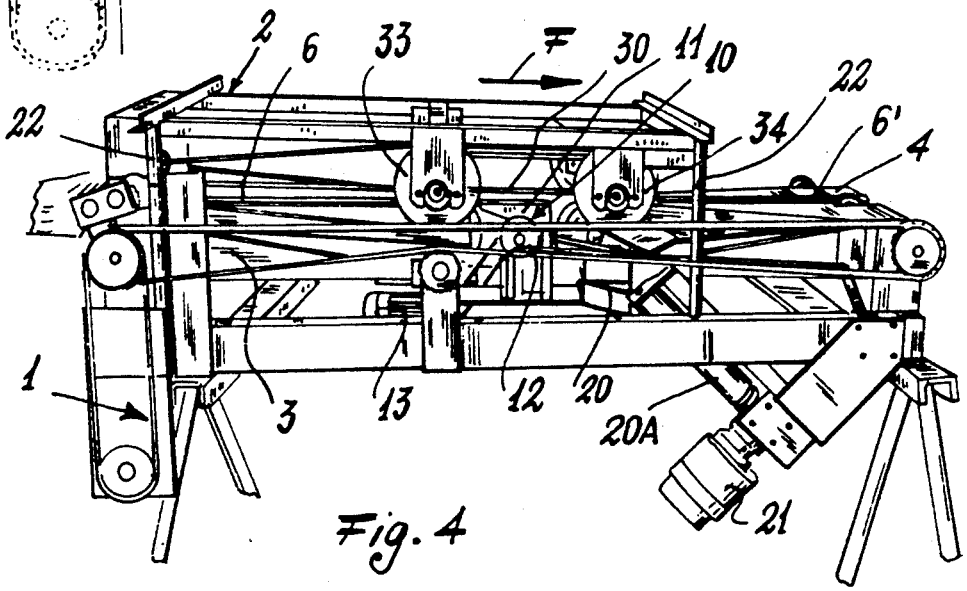
Figure 2:
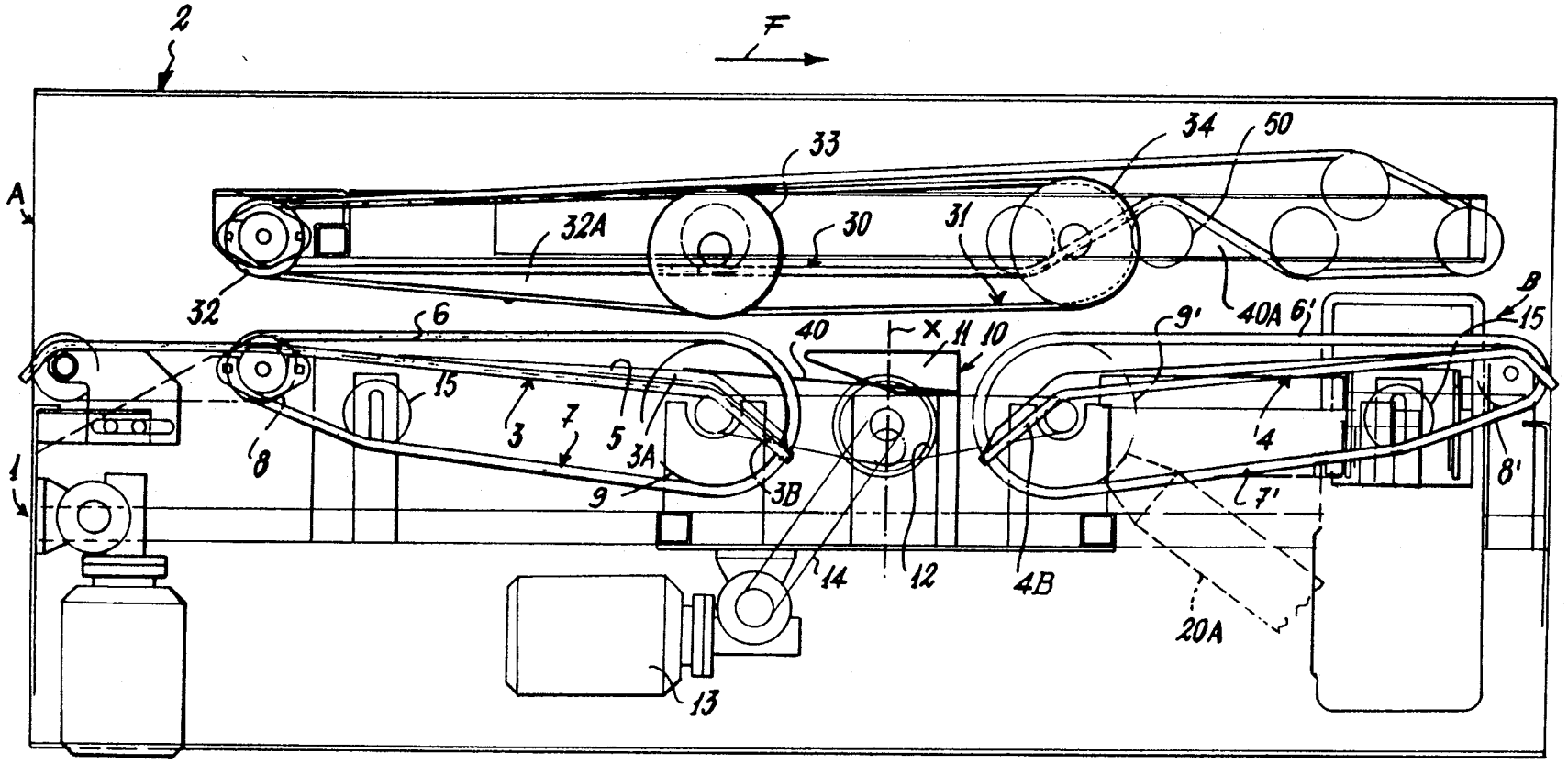
FIG. 2 is a schematic side elevation, with parts omitted for clarity, of the device according to the invention for unbinding the pack of FIG. 1.

With reference to the figures, the letter P indicates overall a pack formed from a given number of sacks S of any type, bound into a pack by a binding formed from two spaced strips indicated by R. In particular, the sacks S can be those used to contain cement and be of the sewn or glued open mouthed or valve type.

The problem solved by the invention is to unbind the packs by cutting and removing the binding (i.e. the straps R) such that the sacks of the pack can be individually removed, for example in the case of a cement works by the conventional sack application equipment, the known purpose of which is to apply the sack to the delivery port for the incoherent material which is to form the sack contents. Both the sack application equipment and the filling equipment comprising said delivery ports are well known in the cement industry.

The device of the invention comprises a stationary load-bearing structure 1 which supports a height-adjustable frame 2. The stationary load-bearing structure 1 carries a slide surface 3 at the entry end A for the bound pack and an analogous slide surface 4 at the exit end B for the unbound pack. The pack movement is indicated by the arrow F. These surfaces have a particular shape, which is described in detail hereinafter. They support the pack, both when bound and when unbound. Each slide surface 3, 4 is divided into two parts by an interspace or longitudinal gap 5, from which there emerges the substantially horizontally extending active part 6, 6' of an endless belt 7, 7' which passes about pulleys 8, 8' and 9, 9', one of which is motorized in any known manner. The two belts are synchronized by any known transmission means.

The two belts 7, 7' lie substantially in the same plane, one following the other, and between them the stationary structure 1 carries an inverted L-shaped member, indicated by 10, of which the horizontal part 11 is wedge-shaped with a rounded end. To the side of the horizontal part 11 of the member 10 there is supported a circular blade 12 driven by a motor 13 via a belt 14. Conventional tensioning devices for the belts 7, 7' are indicated by 15.

The slide surface 3 is initially horizontal substantially over its entire width, and then inclines downwards at 3A to comprise two substantially triangular lateral faces, which are inclined starting from a line K forming in a certain sense the corner of a dihedron. That end of the surface 3 facing the rotary blade 12 is bent sharply downwards at 3B. The other slide surface, i.e. the exit surface 4, is substantially symmetrical to the surface 3 about a vertical transverse plane X containing the axis of the rotary blade 12.

A guide bar 20 outwardly inclined to the longitudinal axis of the device commences on one side of the rotary blade 12, its purpose being to direct one of the hanging ends of the straps after their cutting towards a pair of rollers 20A which are inclined to the horizontal and rotate in opposite directions at extremely high speed under the control of a motor and gears 21.

Said end of the straps is gripped between said rollers 20A, which by their movement remove the straps from the pack of sacks. The frame 2 is vertically adjustable for example by means of screw uprights 22 which are manually adjustable and support the frame 2 on the stationary load-bearing structure 1. This facility for adjustment enables the unbinding device of the invention to be adapted to packs of different height, for example because they comprise different numbers of sacks.

Figure 5:
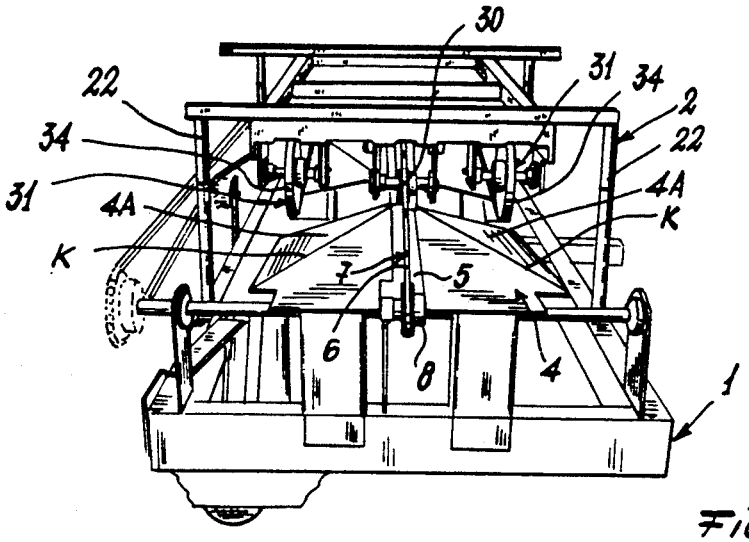
Figure 6:
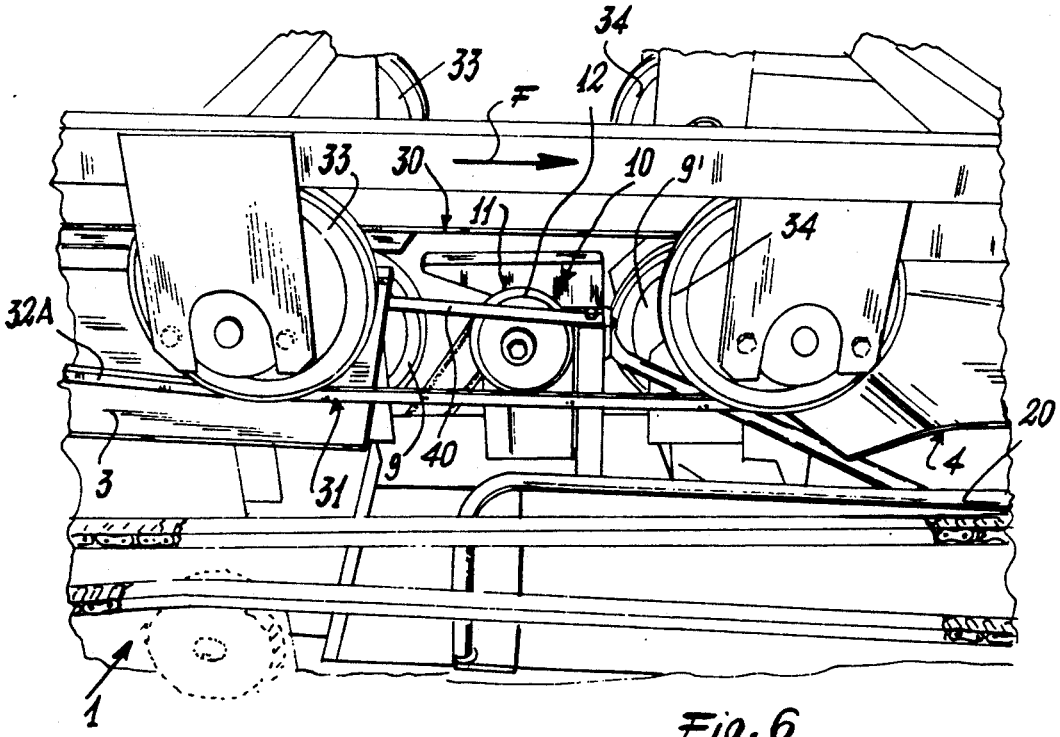
Figure 7:
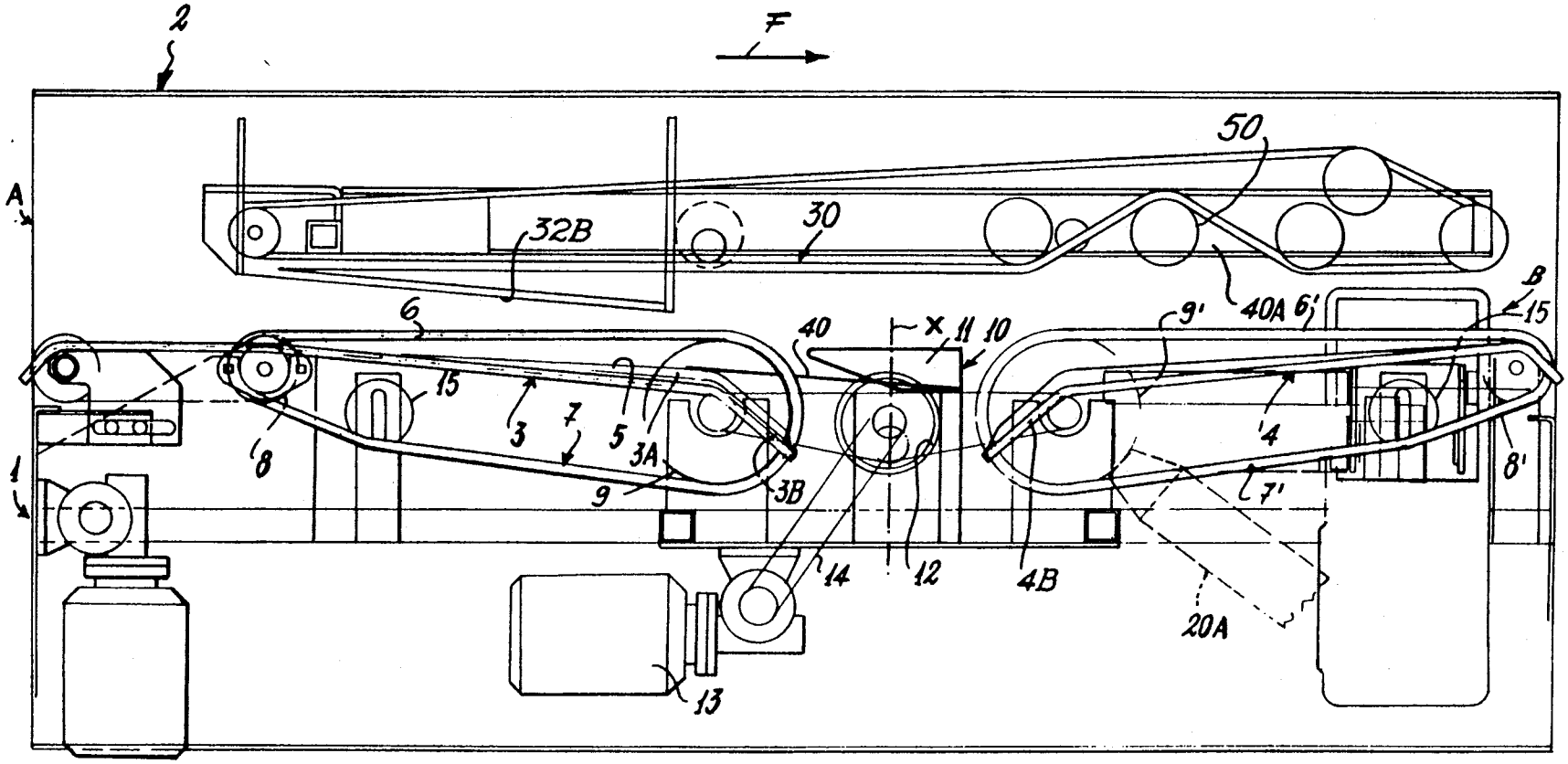
FIG. 7 represents the embodiment wherein the profiling slide guides are present.

The frame 2 carries three endless belts, one of which, extending substantially along the entire length of the unbinding device, is indicated by 30 and is situated in the same longitudinal vertical plane as the belts 3, 4, whereas the other two 31, which are parallel to each other, are situated laterally to the preceding, as can be clearly seen in FIG. 5. The two lateral belts 31 pass over three pulleys 32, 33, 34, the first 32 being of smaller diameter than the others, so that these belts have an initial active portion 32A which is inclined downwards in the direction F of advancement of the pack to cause the sides of the pack, i.e. the regions on the two sides of the centre line T of the pack, to adhere to the laterally inclined parts (3A, 4A) of the slide surfaces 3, 4, whereas the central part along the centre line remains at a higher level by the counteraction of the central belts 7. In other words, the pack is in a certain sense "bent" along its centre line T.

When the first strap R of the pack reaches the end of the slide surface 3, it remains bent whereas the strap in question separates from the underside of the pack because it assumes a straight path. This part of the strap, guided by two guide plates 40 arranged on the two sides of the assembly formed by the member 10 and rotary blade 12, engages the inclined face of the part 11 of the member 10, which leads it to the rotary blade 12 for cutting. The suspended cut end of the strap advances with the pack towards the exit B, and slides against the guide bar 20 which guides it towards the two counter-rotating rollers 20A which remove the strap from the pack by the traction action transverse to the pack.

It interesting to note that to facilitate this strap removal, in the region in which this removal takes place the conveying action exercized by the portions 32A of the two lateral belts 31 ceases, as does that exerted by the central upper belt 30, which in this region undergoes a change in its travel path at 40A by means of a pulley 50, this change being in the form of a withdrawing loop. Consequently any resistance which could have opposed the removal of the cut straps of the pack is reduced. The pack free of straps leaves the device of the invention under the thrust of the upper and lower central belts 30 and 7', losing its central bend, i.e. acquiring planarity. The pack is then fed by conveyor means to its user, for example the stated sack applicator.

The invention also covers an embodiment in which the upper lateral conveyors are replaced by shaping (and hence stationary) slide guides, 32B i.e. arranged to perform the thrust function which in the initially described lateral conveyors is performed by their active portion 32A.

I claim:

1. A device for unbinding sacks bound into packs, comprising a profiled resting surface having a center and a periphery, said surface descending in a downward direction from said center to said periphery, said surface including a longitudinal gap, an endless central conveyor extending through said longitudinal gap in said surface, said central conveyor arranged to convey packs comprising bound sacks such that said central conveyor contacts lower faces of the packs, conveying means positioned on both sides of said central conveyor, said conveying means arranged to contact upper faces of the packs, the packs contacting said surface and being deformed such that upon leaving said surface, a binding or bindings on the packs separate from the lower faces of the packs, a cutting tool for cutting the binding or bindings from the packs, said cutting tool arranged downstream from said surface, and removal means located downstream from said cutting tool for removing the binding or bindings from the packs after the binding or bindings have been cut by said cutting tool.

2. A device as claimed in claim 1, wherein said central endless conveyor is a belt conveyor.

3. A device as claimed in claim 1, wherein said conveying means comprise endless conveyors.

4. A device as claimed in claim 3, wherein said endless conveyors are belt conveyors.

5. A device as claimed in claim 4, wherein said endless conveyors include a portion substantially overlying said surface, said endless conveyors being inclined downwards in a direction of movement of the packs.

6. A device as claimed in claim 1, further comprising an upper central endless conveyor arranged between said conveying means, said upper central endless conveyor arranged to contact the upper face of the packs.

7. A device as claimed in claim 6, further comprising an exit resting surface located downstream from said cutting tool, the packs being straightened via said exit resting surface, and a second endless central conveyor projecting from said exit resting surface, said second endless central conveyor discharging the packs from said exit resting surface.

8. A device as claimed in claim 7, further comprising a region between said cutting tool and said removal means wherein said second endless central conveyor operates on said packs directly and said upper central endless conveyor separating from the upper face of the packs in said region, such that a dragging action on the pack is reduced.

9. A device as claimed in claim 1, wherein said conveying means comprise profiled slide guides.

10. A device as claimed in claim 9, wherein said profiled slide guides include a portion substantially overlying said surface, said endless conveyors being inclined downwards in a direction of movement of the packs.

11. A device as claimed in claim 6, wherein said conveying means comprise profiled slide guides.

* * * * *